US006340260B1

(12) United States Patent
Dao

(10) Patent No.: US 6,340,260 B1
(45) Date of Patent: Jan. 22, 2002

(54) MARKER ASSEMBLY HAVING HINGED CAP

(76) Inventor: Kevin P. Dao, 823 S. Dennis St., Santa Ana, CA (US) 92704

( * ) Notice: Subject to any disclaimer, the term of this patent is extended or adjusted under 35 U.S.C. 154(b) by 0 days.

(21) Appl. No.: 09/675,134

(22) Filed: Sep. 29, 2000

(51) Int. Cl.[7] ..... B43K 5/00
(52) U.S. Cl. ..... 401/202; 401/126
(58) Field of Search ..... 401/202, 196, 401/198, 269, 262, 213, 243, 244, 245, 246, 247; D19/43, 42, 41, 57; 215/245, 244, 236, 235

(56) References Cited

U.S. PATENT DOCUMENTS

| | | | | | |
|---|---|---|---|---|---|
| 1,586,369 | A | * | 5/1926 | Koplow | 401/44 |
| 1,615,506 | A | * | 1/1927 | Felt | 401/202 |
| 1,859,775 | A | * | 5/1932 | Hyams | 401/202 |
| 2,320,936 | A | * | 6/1943 | Kessler | 401/44 |
| 2,370,414 | A | * | 2/1945 | Ostrander | 401/202 |
| 2,594,467 | A | * | 4/1952 | Lynch, Jr. et al. | 215/43 |
| 3,723,048 | A | | 3/1973 | Russell | |
| 4,060,373 | A | | 11/1977 | Paroty | |
| 4,518,273 | A | * | 5/1985 | Larizza | 401/98 |
| 4,575,271 | A | * | 3/1986 | Hashimoto et al. | 401/107 |
| D284,290 | S | * | 6/1986 | Concillio et al. | D19/36 |
| 4,653,949 | A | | 3/1987 | Larizza | |
| D326,682 | S | * | 6/1992 | Kimura | D19/42 |
| 5,119,838 | A | * | 6/1992 | Nakazima | 131/108 |
| 5,176,460 | A | | 1/1993 | Garry | |
| 5,352,053 | A | * | 10/1994 | Reitze | 401/202 |
| D366,279 | S | * | 1/1996 | Voorhees | D19/36 |
| 5,494,185 | A | | 2/1996 | Dubach | |
| D389,515 | S | | 1/1998 | Van Swieten | |

* cited by examiner

*Primary Examiner*—Greogory L. Huson
*Assistant Examiner*—Huyen Le

(57) ABSTRACT

A marker assembly having hinged cap for preventing the loss of the cap. The marker assembly having hinged cap includes a housing that has an interior for holding ink. A wick member is coupled to the housing. The wick member extends into the interior. The wick member has a writing tip extending outwardly from the housing for dispensing ink through the wick member. A cap member is hingably coupled to the housing.

8 Claims, 2 Drawing Sheets

MARKER ASSEMBLY HAVING HINGED CAP

BACKGROUND OF THE INVENTION

1. Field of the Invention

The present invention relates to marker assemblies and more particularly pertains to a new marker assembly having hinged cap for preventing the loss of the cap.

2. Description of the Prior Art

The use of marker assemblies is known in the prior art. More specifically, marker assemblies heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,653,949; 5,494,185; 3,723,048; 4,060,373; 5,176,460; and U.S. Pat. No. Des. 389,515.

While these devices fulfill their respective, particular objectives and requirements, the aforementioned patents do not disclose a new marker assembly having hinged cap. The inventive device includes a housing that has an interior for holding ink. A wick member is coupled to the housing. The wick member extends into the interior. The wick member has a writing tip extending outwardly from the housing for dispensing ink through the wick member. A cap member is hingably coupled to the housing.

In these respects, the marker assembly having hinged cap according to the present invention substantially departs from the conventional concepts and designs of the prior art, and in so doing provides an apparatus primarily developed for the purpose of preventing the loss of the cap.

SUMMARY OF THE INVENTION

In view of the foregoing disadvantages inherent in the known types of marker assemblies now present in the prior art, the present invention provides a new marker assembly having hinged cap construction wherein the same can be utilized for preventing the loss of the cap.

The general purpose of the present invention, which will be described subsequently in greater detail, is to provide a new marker assembly having hinged cap apparatus and method which has many of the advantages of the marker assemblies mentioned heretofore and many novel features that result in a new marker assembly having hinged cap which is not anticipated, rendered obvious, suggested, or even implied by any of the prior art marker assemblies, either alone or in any combination thereof.

To attain this, the present invention generally comprises a housing that has an interior for holding ink. A wick member is coupled to the housing. The wick member extends into the interior. The wick member has a writing tip extending outwardly from the housing for dispensing ink through the wick member. A cap member is hingably coupled to the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new marker assembly having hinged cap apparatus and method which has many of the advantages of the marker assemblies mentioned heretofore and many novel features that result in a new marker assembly having hinged cap which is not anticipated, rendered obvious, suggested, or even implied by any of the prior art marker assemblies, either alone or in any combination thereof.

It is another object of the present invention to provide a new marker assembly having hinged cap that may be easily and efficiently manufactured and marketed.

It is a further object of the present invention to provide a new marker assembly having hinged cap that is of a durable and reliable construction.

An even further object of the present invention is to provide a new marker assembly having hinged cap that is susceptible of a low cost of manufacture with regard to both materials and labor, and which accordingly is then susceptible of low prices of sale to the consuming public, thereby making such marker assembly having hinged cap economically available to the buying public.

Still yet another object of the present invention is to provide a new marker assembly having hinged cap which provides in the apparatuses and methods of the prior art some of the advantages thereof, while simultaneously overcoming some of the disadvantages normally associated therewith.

Still another object of the present invention is to provide a new marker assembly having hinged cap for preventing the loss of the cap.

Yet another object of the present invention is to provide a new marker assembly having hinged cap which includes a housing that has an interior for holding ink. A wick member is coupled to the housing. The wick member extends into the interior. The wick member has a writing tip extending outwardly from the housing for dispensing ink through the wick member. A cap member is hingably coupled to the housing.

Still yet another object of the present invention is to provide a new marker assembly having hinged cap that helps prevent a child from swallowing a lost cap.

Even still another object of the present invention is to provide a new marker assembly having hinged cap that is easy to use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
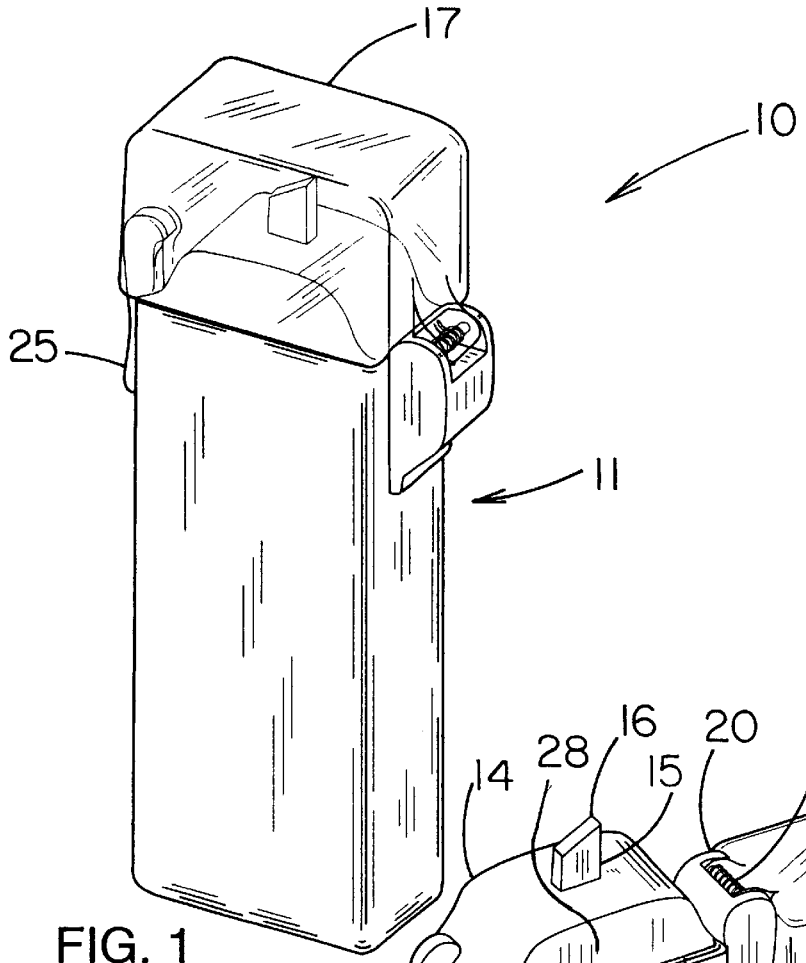
FIG. 1 is a schematic perspective view of a new marker assembly having hinged cap according to the present invention.
Figure 2:
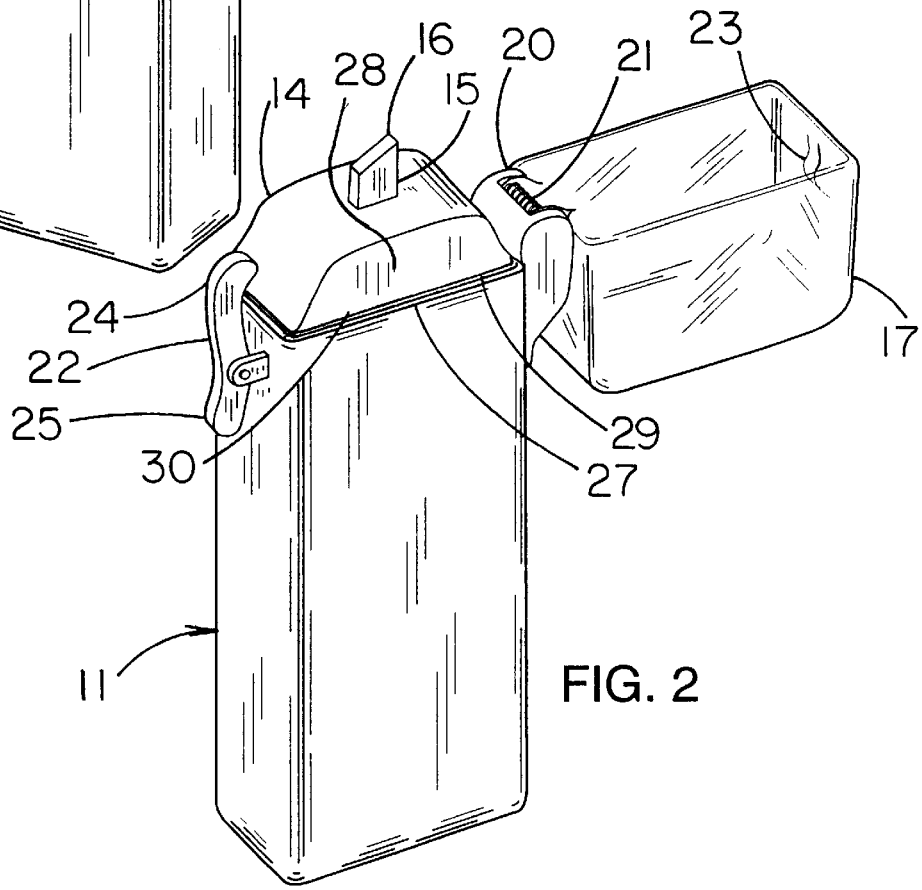
FIG. 2 is a schematic perspective view of the present invention, illustrating the cap member in the open position.
Figure 3:
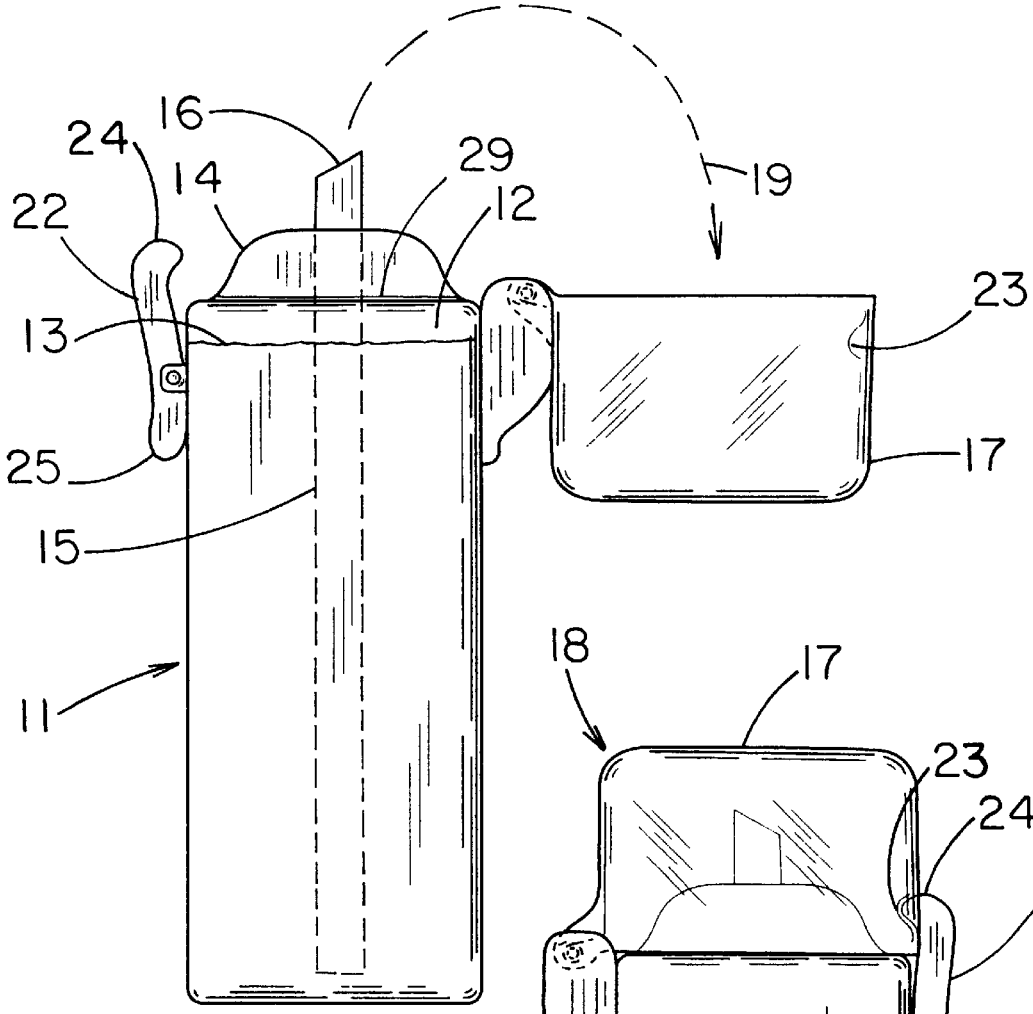
FIG. 3 is a schematic side view of the present invention, illustrating the cap member in the open position.
Figure 4:
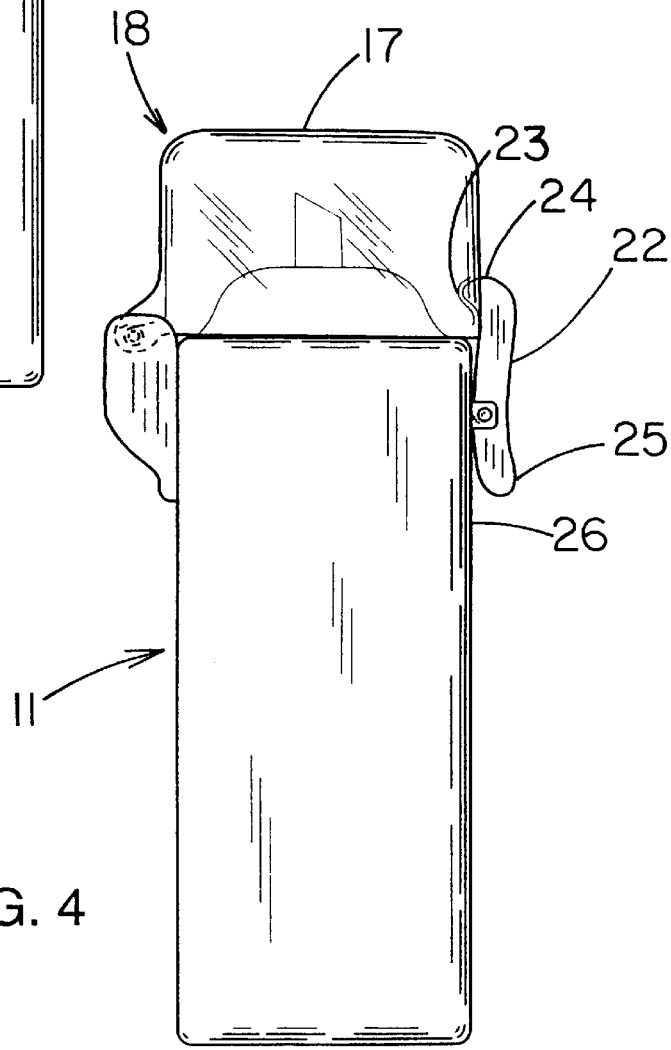
FIG. 4 is a schematic side view of the present invention, illustrating the cap member in the closed position.

With reference now to the drawings, and in particular to FIGS. 1 through 4 thereof, a new marker assembly having hinged cap embodying the principles and concepts of the present invention and generally designated by the reference numeral 10 will be described.

As best illustrated in FIGS. 1 through 4, the marker assembly having hinged cap 10 generally comprises a housing 11 that has an interior 12 for holding ink 13. The housing 11 has an upper end 14.

A wick member 15 is coupled to the housing 11. The wick member 15 extends into the interior 12. The wick member 15 has a writing tip 16 that extends outward from the housing 11 for dispensing ink 13 through the wick member 15.

A cap member 17 is hingably coupled to the housing. The cap member 17 may pivot between a closed position 18 and an open position 19. The closed position is defined by when the cap member 17 covers the wick member 15. The open position 19 is defined when the cap member 17 is pivoted away from the wick member 15. The open position 19 permits dispensing of ink 13 onto a recipient surface by the writing tip 16 of the wick member 15.

A cap biasing member 20 holds the cap member 17 in the open position 19 during use. The cap biasing member 20 includes a biasing spring 21 which asserts constant pressure on the cap member 17 towards the open position 19 orientation.

The marker assembly 10 also has a clip member 22. The clip member 22 selectively holds the cap member 17 in the closed position 18. The cap member 17 has a catch portion 23. The clip member 22 is pivotally coupled to the housing 11. The clip member 22 has a first end 24 for engaging the catch portion 23 of the cap member 17. When the clip member 22 is engaged with the catch portion 23, the cap member 17 is prevented from being pivoted into the open position 19 by the cap biasing member 20.

The clip member 22 has a second end 25 opposite the first end 24. The second end 25 is positioned in spaced relationship to an outer surface 26 of the housing 11 when the first end 24 is engaged to the catch portion 23. If the first end 24 is engaged to the catch portion 23, depression of the second end 25 of the clip member 22 towards the outer surface 26 of the housing 11 disengages the first end 24 from the catch portion 23. If the first end of the clip member 22 is disengaged from the catch portion 23, the cap biasing member 20 pivots the cap member 17 into the open position 19.

The cap member 17 may be made transparent for permitting visual inspection of the wick member 15 when the cap member 17 is in the closed position 18.

The writing tip 16 of the wick member 15 has a substantially rectangular cross-section for facilitating writing a line. The line produced by the writing tip 16 has a first width when the writing tip 16 is moved across the recipient surface that is transverse to a length of the rectangular cross-section. In addition, the line produced by the writing tip 16 has a second width when the writing tip 16 is moved across a recipient surface transverse to a width of the cross-section.

The housing 11 has an upper surface 30. The upper surface 30 has an outer perimeter edge 27 and a raised interior portion 28. The writing tip 16 extends upward from the raised interior portion 28 of the upper surface 30. This design facilitates the application of the writing tip 16 onto the recipient surface for facilitating use of the marker assembly 10. In addition, a rubber seal 29 lines the outer perimeter edge 27 to prevent evaporation of the ink 13 when the cap member 17 is in the closed position 18.

In use, the second end 25 of the clip member 22 is depressed toward the outer surface 26 of the housing 11. This action releases the cap member 17 to the open position 19. The marker assembly 10 may then be used to transfer ink 13 to a recipient surface. When finished, the cap member 17 is returned to the closed position 18 and the first end 24 of the clip member 22 is engaged in the catch portion 23 of the cap member 17 for storage.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, colors, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A marker assembly comprising:

a housing having an interior for holding ink, said housing having an upper end;

a wick member coupled to said housing, said wick member extending into said interior, said wick member having a writing tip extending outwardly from said housing for dispensing ink through said wick member;

a cap member hingably coupled to said housing, said cap member being pivotable between a closed position defined by said cap member covering said wick member and an open position defined by said cap member being pivoted away from said wick member for permitting dispensing of ink onto a recipient surface by said writing tip of said wick member;

a cap biasing member for holding said cap member in said open position during use, and a clip member for selectively holding said cap member in said closed position.

2. The marker assembly of claim 1, further comprising: a cap biasing member for holding said cap member in said said clip member being pivotally coupled to said housing, said clip member having a first end for engaging said catch portion of said cap member whereby said cap member is prevented from being pivoted into said open position by said cap biasing member when said first end of said clip member is engaged to said catch portion.

3. The marker assembly of claim 2, further comprising:

said clip member including a second end opposite said first end, said second end being positioned in spaced relationship to an outer surface of said housing when said first end is engaged to said catch portion whereby depression of said second end such that said second end is moved towards said outer surface of said housing disengages said first end from said catch portion whereby said cap biasing member pivots said cap member into said open position.

4. The marker assembly of claim 1, further comprising:

said cap member being transparent for permitting visual inspection of said wick member when said cap member is in said closed position.

5. The marker assembly of claim 1, further comprising:

said writing tip of said wick member having a substantially rectangular cross-section for facilitating writing a line having a first width when said writing tip is moved across the recipient surface transverse to a length of said rectangular cross-section and writing a line having a second width when said writing tip is moved across a recipient surface transverse to a width of said cross-section.

6. The marker assembly of claim 1, further comprising:

said housing having an upper surface, said upper surface having an outer perimeter edge and a raised interior portion; and said writing tip extending upwardly from said raised interior portion of said upper surface for facilitating application of said writing tip to the recipient surface for facilitating use of said marker assembly.

7. The marker assembly of claim 6, further comprising:

a rubber seal being coupled to said outer perimeter edge, the rubber seal being adapted to engage said cap member when said cap member is in said closed position for preventing evaporation of said ink when not in use.

8. A marker assembly comprising:

a housing having an interior for holding ink, said housing having an upper end;

a wick member coupled to said housing, said wick member extending into said interior, said wick member having a writing tip extending outwardly from said housing for dispensing ink through said wick member;

a cap member hingably coupled to said housing, said cap member being pivotable between a closed position defined by said cap member covering said wick member and an open position defined by said cap member being pivoted away from said wick member for permitting dispensing of ink onto a recipient surface by said writing tip of said wick member;

a cap biasing member for holding said cap member in said open position during use;

a clip member for selectively holding said cap member in said closed position;

said cap member having a catch portion;

said clip member being pivotally coupled to said housing, said clip member having a first end for engaging said catch portion of said cap member whereby said cap member is prevented from being pivoted into said open position by said cap biasing member when said first end of said clip member is engaged to said catch portion;

said clip member including a second end opposite said first end, said second end being positioned in spaced relationship to an outer surface of said housing when said first end is engaged to said catch portion whereby depression of said second end such that said second end is moved towards said outer surface of said housing disengages said first end from said catch portion whereby said cap biasing member pivots said cap member into said open position;

said cap member being transparent for permitting visual inspection of said wick member when said cap member is in said closed position;

said writing tip of said wick member having a substantially rectangular cross-section for facilitating writing a line having a first width when said writing tip is moved across the recipient surface transverse to a length of said rectangular cross-section and writing a line having a second width when said writing tip is moved across a recipient surface transverse to a width of said cross-section;

said housing having an upper surface, said upper surface having an outer perimeter edge and a raised interior portion;

said writing tip extending upwardly from said raised interior portion of said upper surface for facilitating application of said writing tip to the recipient surface for facilitating use of said marker assembly; and a rubber seal being coupled to said outer perimeter edge, the rubber seal being adapted to engage said cap member when said cap member is in said closed position for preventing evaporation of said ink when not in use.

* * * * *